US009463658B2

(12) United States Patent
Irwin et al.

(10) Patent No.: US 9,463,658 B2
(45) Date of Patent: Oct. 11, 2016

(54) METHOD AND APPARATUS FOR STAMPING CONCRETE

(71) Applicant: JP Design Works, LLC, Oceanside, CA (US)

(72) Inventors: Jeff Irwin, Oceanside, CA (US); Paul A. Sowa, Oceanside, CA (US)

(73) Assignee: JP DESIGN WORKS, LLC, Oceanside, CA (US)

( * ) Notice: Subject to any disclaimer, the term of this patent is extended or adjusted under 35 U.S.C. 154(b) by 0 days.

(21) Appl. No.: 14/470,592

(22) Filed: Aug. 27, 2014

(65) Prior Publication Data

US 2016/0059602 A1 Mar. 3, 2016

(51) Int. Cl.
*B41K 1/32* (2006.01)

(52) U.S. Cl.
CPC ..... *B41K 1/32* (2013.01)

(58) Field of Classification Search
CPC ..... B28B 11/08; B28B 11/089; B41K 1/02; B41K 1/366; B41J 1/20
USPC ..... 101/12, 333
See application file for complete search history.

(56) References Cited

U.S. PATENT DOCUMENTS

| | | | | |
|---|---|---|---|---|
| 5,487,526 | A | 1/1996 | Hupp | |
| 5,487,656 | A | 1/1996 | Kaitanjian | |
| 6,471,335 | B1 * | 10/2002 | Gelbart | 347/49 |
| 8,317,502 | B1 | 11/2012 | Grey | |
| 8,470,229 | B2 | 6/2013 | Nasvik et al. | |
| 2001/0013294 | A1 * | 8/2001 | Bruno et al. | 101/327 |
| 2002/0042994 | A1 * | 4/2002 | Ito et al. | 29/890.1 |
| 2005/0181293 | A1 * | 8/2005 | Lee | 430/98 |
| 2008/0145130 | A1 * | 6/2008 | Marsden et al. | 400/692 |
| 2008/0173787 | A1 * | 7/2008 | Nasvik et al. | 249/189 |
| 2011/0048258 | A1 * | 3/2011 | Shih | 101/333 |
| 2011/0123977 | A1 * | 5/2011 | Sprenkels et al. | 435/5 |
| 2012/0032377 | A1 * | 2/2012 | Montelius et al. | 264/408 |
| 2013/0177354 | A1 | 7/2013 | Farrell | |
| 2014/0110879 | A1 * | 4/2014 | O'Hare et al. | 264/225 |

* cited by examiner

*Primary Examiner* — David Banh
(74) *Attorney, Agent, or Firm* — Knobbe Martens Olson & Bear LLP

(57) ABSTRACT

Methods and apparatus are disclosed for stamping concrete. In one aspect, a method of creating a pattern in a surface is provided. The method includes placing a first stamp in a first position, the first stamp comprising a first engagement structure. The method further includes placing a second stamp in a second position, the second stamp comprising a second engagement structure, which engages with the first engagement structure so as to position the second stamp relative to the first stamp. The apparatus may include a separate coupling structure for attaching adjacent stamps to each other.

16 Claims, 14 Drawing Sheets

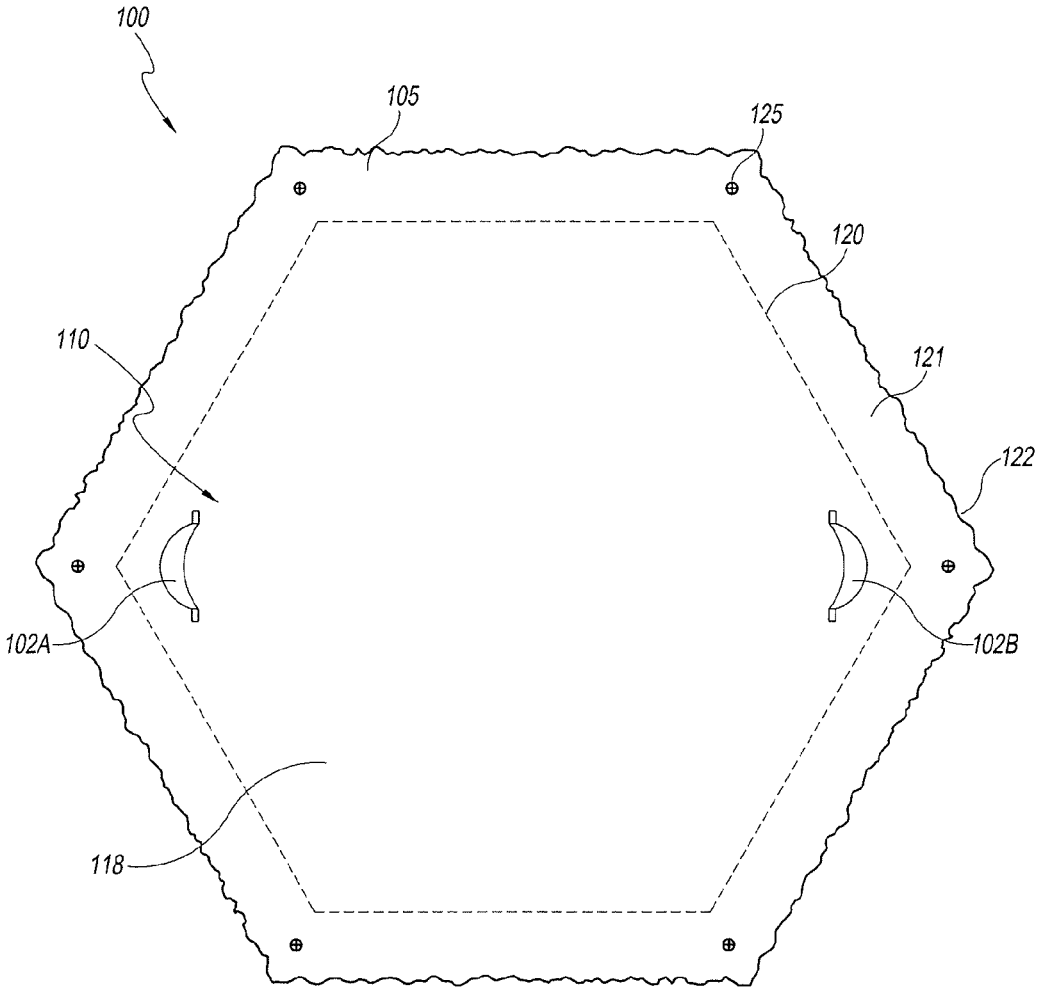
FIG. IB

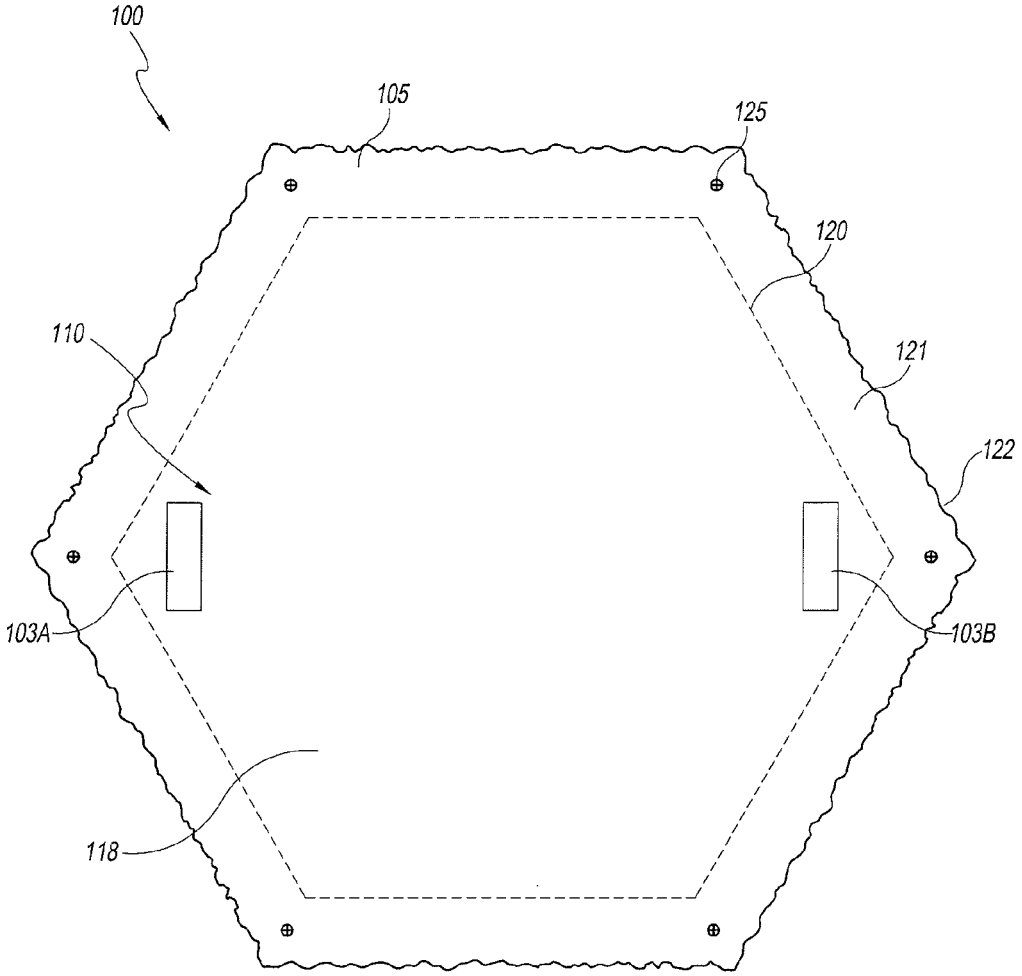
FIG. IC

METHOD AND APPARATUS FOR STAMPING CONCRETE

FIELD

The present invention relates generally to the field of concrete stamping. In particular, the present invention relates to a stamp to imprint a pattern.

BACKGROUND

Tools for forming decorative patterns in concrete to provide the appearance of brick, cobblestone, slate, stone, tile and wood have gained in popularity in recent years. There are a number of advantages to using such tools in concrete as opposed to the authentic hand-laid materials. First, the cost of materials and labor to imprint the pattern in a bed of concrete is greatly reduced from that of laying real stone or brick. In addition, the concrete provides an extremely durable and lasting surface when cured. Independent hand-laid stones or bricks have gaps in between which, despite being filled with mortar, may cause them to settle to result in an uneven surface. Finally, a solid layer of concrete prevents the disruptive, unsightly upgrowth of weeds or other vegetation which inevitably occurs with separate stones or bricks.

However, problems are frequently encountered when a stamp is repeated in a continuous pattern. One problem arises due to the manner in which the stamps are arranged next to each other. When individual stamps having generally linear sides are positioned adjacent to one another, it may become possible for the human eye to identify the joint created by the stamps in the finished work. This is particularly true when the shape of the stamp is a simple shape, such as a rectangle. Performing a successful simulated stone or brick flooring typically requires quite skillful and experienced installers using several stamps (tools) to create the texture or pattern because of inherent problems due to the design nature of the stamps. Stamps are typically cast at least half of an inch thick with flexible elastomer material. Weight restrictions ultimately limit the size of both the stamp and the pattern. Also, because the stamps must fit tightly alongside one another to produce a complete pattern, alignment becomes critical as the stamps are moved and positioned across the concrete or other imprinting surface. As the installer tamps the stamps into the concrete, the stamps tend to shift, slowing the installation process by producing uneven spacing and formations of excess concrete between the stamps. Also, due to the size and positioning of the stamps, the concrete may shift and create excess mounds of concrete between the stamps as the textures or imprints are being stamped into the concrete or as the stamps are lifted from the concrete. This also slows installation because the installer may need to manually fix any imperfections with precise tools. Therefore improved methods and apparatus are needed to more efficiently and effectively stamp concrete.

SUMMARY

Various implementations of systems, methods and devices within the scope of the appended claims each have several aspects, no single one of which is solely responsible for the desirable attributes described herein. Without limiting the scope of the appended claims, some prominent features are described herein.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

A method of creating a pattern in a surface is disclosed. The method includes placing a first stamp in a first position, the first stamp comprising a first engagement structure. The method further includes placing a second stamp in a second position, the second stamp comprising a second engagement structure, which engages with the first engagement structure so as to position the second stamp relative to the first stamp.

A stamp for forming an imprint in a surface is disclosed. The stamp includes a body having an engagement structure for engaging the body with another stamp so as to position the body relative to the other stamp.

A stamp for forming an imprint in a surface is disclosed. The stamp includes an engagement structure having at least one magnet configured to create a magnetic attraction with an adjacent stamp.

BRIEF DESCRIPTION OF THE DRAWINGS

FIG. 1B is a top view of the stamp of FIG. 1A.

FIG. 1C is a top view of the stamp of FIG. 1A showing recessed handles.

DETAILED DESCRIPTION

The following description and examples illustrate exemplary embodiments of the present invention and is not intended to represent the only embodiments in which the invention may be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. In some instances, some devices are shown in block diagram form.

Figure 1A:
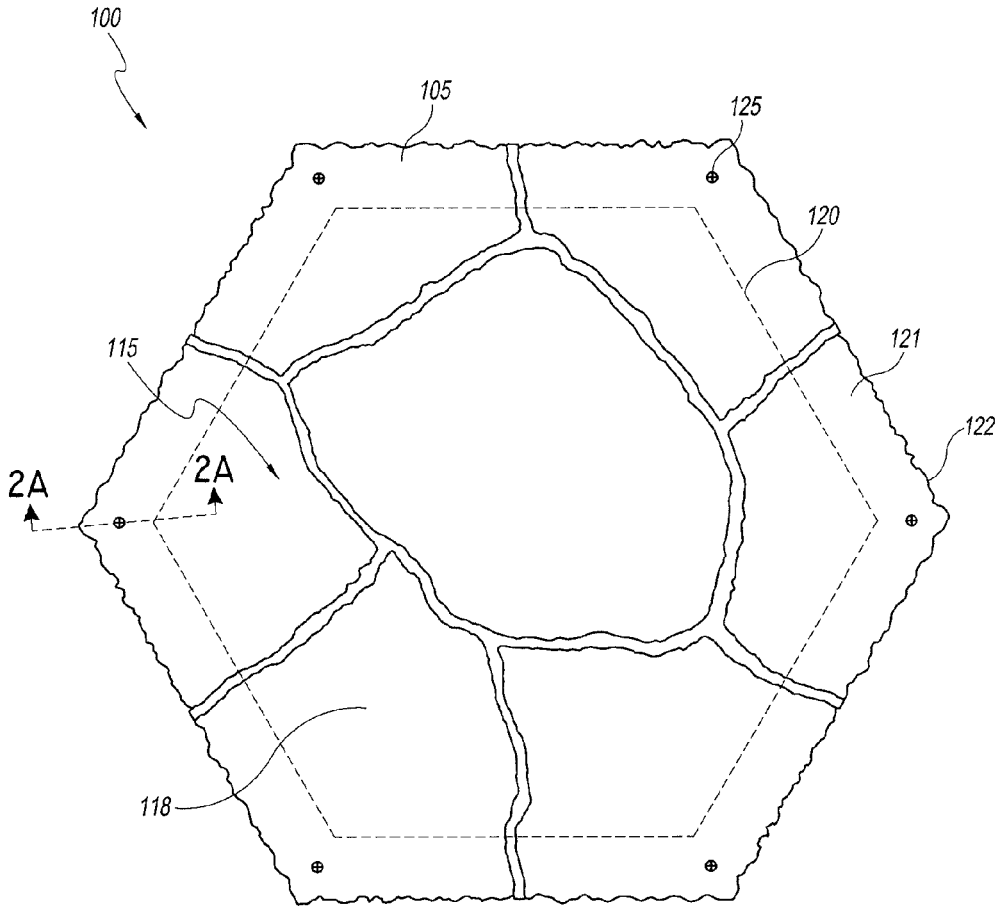
FIG. 1A is a bottom view of a stamp according to one embodiment of the present invention.
Figure 1D:
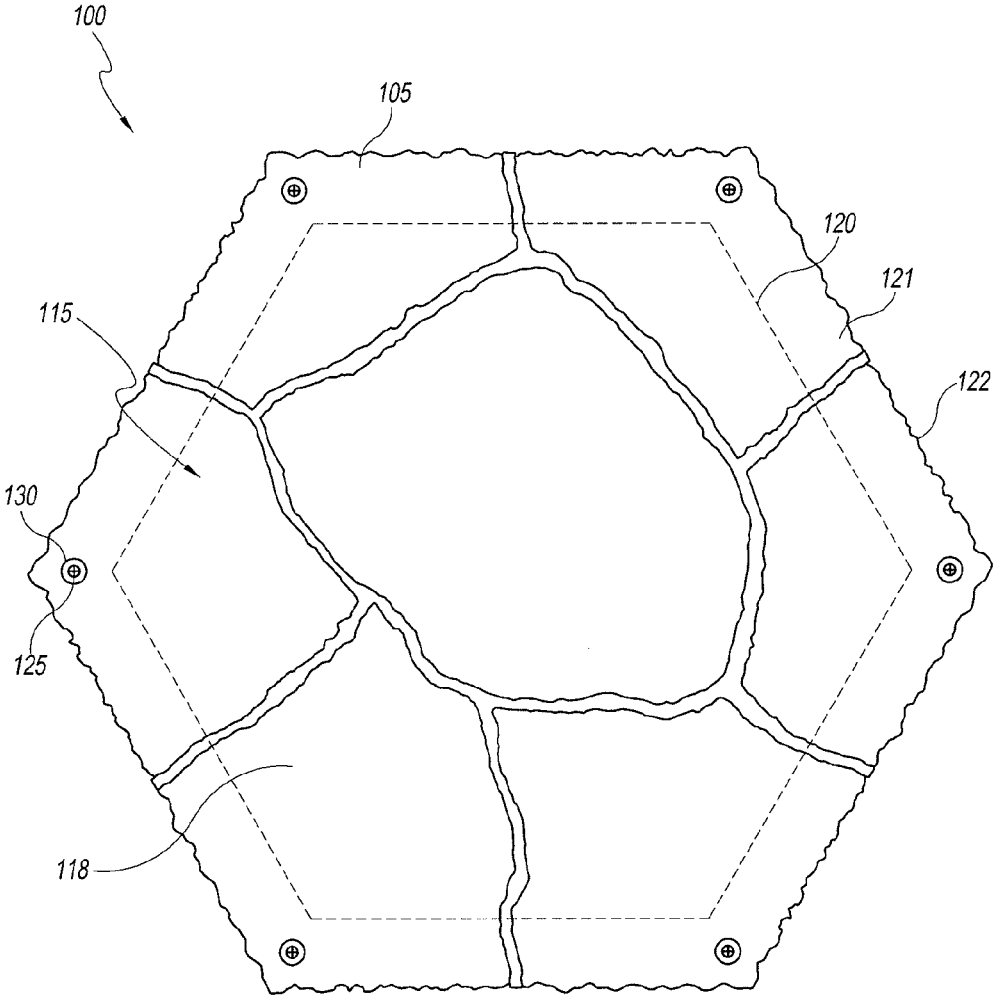
FIG. 1D is a bottom view of a stamp that includes a metal cup surrounding a magnet according to one embodiment of the present invention.
Figure 5:
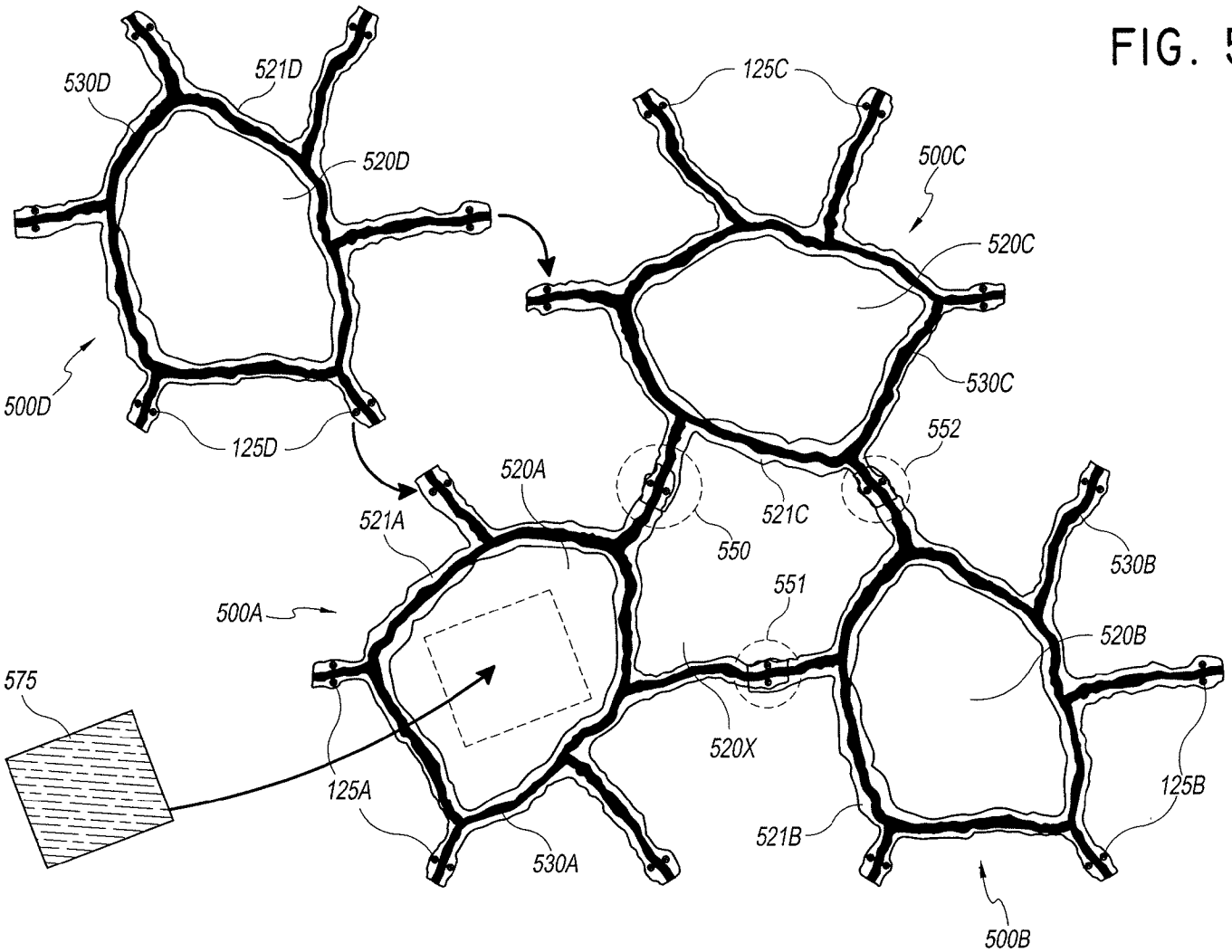
FIG. 5 is a schematic view of a step in a method for creating a pattern using another stamp according to another patterned embodiment of the present invention.

FIG. 1A provides a bottom view of a stamp 100 according to one embodiment of the present invention. The stamp 100 is an exemplary hexagonal mat for imprinting a pattern into a surface such as cement or concrete. The stamp 100 may comprise a body 105 having one or more layers. The body 105 has a top surface 110 (as shown in FIG. 1B) and a bottom surface 115. The body 105 may also include a center portion 118 and a border portion 121. All edges of the stamp 100 may be feathered. As shown in FIG. 1A, the bottom surface 115 includes a stone design to be imprinted on the surface. The stone design encompasses the bottom surface 115, however some designs may not cover the entire bottom surface 115. While a stone design is illustrated here, many other designs are possible, for example brick, tile, cobble stone, travertine, custom stamps, etc. The stamp 100 may also be referred to as a stencil. For example, the stencil may comprise a body which comprises only a stone design, a grout line (or other design) with or without a textured border region surrounding the design (as shown in FIG. 5 and more fully described below).

FIG. 1B is a top view of the stamp 100 from FIG. 1A. As shown, the stamp 100 may further include one or more handles 102A, 102B. The top surface 110 of the stamp 100, as illustrated, includes a flat blank surface with no design. In some embodiments, the top surface 110 may comprise the same stone design as the bottom surface 115 and encompasses the entire top surface 110. Matching the design on the top surface 110 with the design on the bottom surface 115 may facilitate an installer when aligning and affixing multiple stamps 100 relative to each other to during installation. The top surface 110 may also comprise handles 102A and 102B. In some embodiments, the body 105 comprises recesses in the top surface 110 at the locations of the handles 102A, 102B.

FIG. 1C is a top view of the stamp 100 from FIG. 1A showing recessed handles 103A, 103B. The recessed handles 103 may reduce the possibility of the handle 103 imprinting on the surface (e.g., concrete or cement) as may occur with conventional handles. In some aspects, the handles 102A and 102B may be removable from the top surface to allow smooth stamping of the stamp 100. While two handles are shown on opposite sides of the stamp 100, more handles or fewer handles 102 or 103 at different locations are within the scope of the disclosure.

The stamp 100 also includes one or more structures for engaging or registering with an adjacent stamp. For example, the stamps illustrated in FIGS. 1A, 1B, 2A, 2B, and 2C include one or more magnets 125 for engaging adjacent stamps. In certain embodiments, the magnets 125 are disposed around the border portion 121 for connecting and/or aligning multiple stamps 100 on a surface. Though the magnets 125 are shown to be round, they may be of any other geometric shape. In the exemplary embodiments shown in FIGS. 1A, 1B, 1C, 3, and 4A, six magnets are positioned in the border portion 121 of the stamp 100. The number and arrangement of magnets may be changed in any way which facilitates attachment between adjacent stamps 100. In some embodiments, at least two magnets are desirable in order to facilitate attachment between each pair of adjacent stamps. In other embodiments, a single magnet that extends around a substantial portion of the circumference of the stamp 100 may be employed. The magnets 125 may be attached to the stamp 100 by various means known in the art. For example, the magnets 125 may be insert-molded or embedded into the body 105 or attached to the body 105 with an adhesive.

Figure 2A:
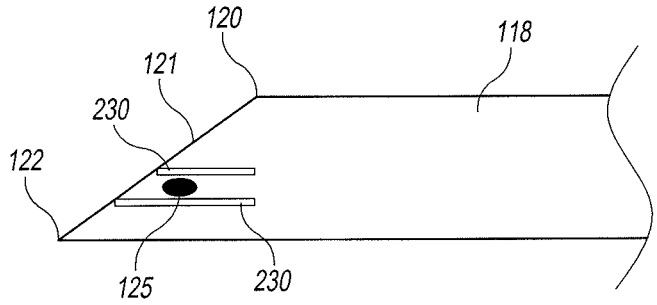
FIG. 2A provides a partial cross-sectional view of the stamp from FIG. 1A along the line 2A-2A.
Figure 2B:
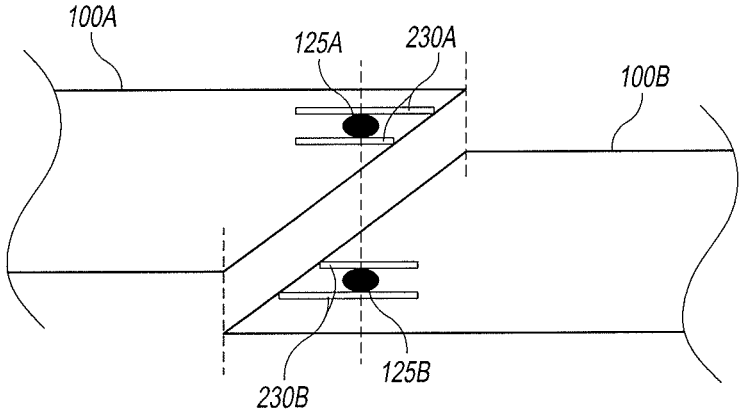
FIG. 2B is a side view of a stamp showing one embodiment of a structure for engaging adjacent stamps using overlapping magnets.
Figure 2C:
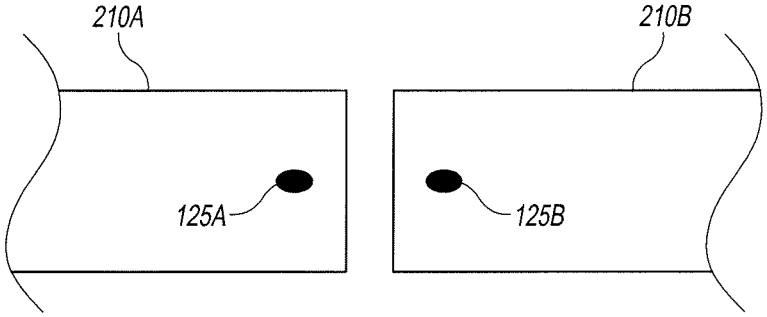
FIG. 2C is a side view of a stamp showing another embodiment of a structure for engaging adjacent stamps using abutting magnets.

Additionally, the magnets 125 may be secured within the body 105 using a structure for reinforcing the magnets 125. The structure may be local to the magnet or may surround the border portion 121. For example, as shown in FIGS. 2A and 2B, the magnet 125 is embedded within the body 105 in the border portion 121. The magnet 125 is secured within the border portion 121 between two Fiberglass layers 230 local to the magnet 125, however one or more layers 230 and materials other than Fiberglass may be used. For example, FIG. 1C provides a bottom view similar to FIG. 1A except a metal cup 130 is employed to support and secure the magnets 125 in the body 105. In other aspects, the metal cup 130 may be substituted with any other reinforcement material to reinforce the magnet 125 or other engagement structure, as described with reference to FIG. 1A. The metal cup 130 may provide certain advantages. In one non-limiting example, the metal cup 130 firmly holds the magnet 125 in its location and may reinforce the magnetic material. Additionally, the metal cup 130 may increase the magnetic attraction between magnets 125 of different stamps 100. The metal cup 130 may comprise any material that has a degree of magnetization that responds to the magnetic field of the magnet 125 such as iron, nickel or steel.

Though magnets 125 are shown in FIGS. 1A, 1B, 1C, 2A, 2B, and 2C, in other embodiments, the magnets may be substituted with any other structure for engaging adjacent stamps. Non-limiting examples of such other structures include mechanical structures such as one or more holes, or recesses configured to receive protrusions, pins, Velcro, adhesives, or any combination of the above.

The border portion 121 further comprises an inner border 120, which connects to the center portion 118, and an outer border 122 which represents the outer edge of the stamp 100. As described above, the edges of the outer border 122 may be feathered. The center portion 118 may comprise one or more sections of varying flexibility and/or thickness. For example, the center portion 118 may have uniform or varying flexibility. For example, in certain embodiments, the rigidity increases toward the center of the stamp 100. In certain embodiments, the flexibility increases towards the inner border portion 120 of the center portion 118. In some embodiments, the border portion 121 may comprise a feathered border which may be more pliable and flexible than another portion of the stamp 100.

The stamp 100 may be formed from one or more layers. One or more of the layers may be made from a pliable and flexible material that is lightweight and easy to handle. For embodiments with multiple layers, the layers may be formed from the same or different materials. In some aspects, the different portions of the stamp 100 (e.g., center portion 118, border portion 121) may comprise different materials with varying durometers to create different degrees of flexibility. In an exemplary embodiment, the stamp 100 is formed at least in part of polyurethane and is approximately ¼ inch thick. The lightweight structure of the stamp 100 may be such that the stamp 100 may be easily lifted by a single person.

FIG. 2A is a partial cross-sectional view of the stamp 100 from FIG. 1A along the line 2A-2A. FIG. 2A illustrates the center portion 118, which includes the border portion 121, the magnet 125 positioned within the border portion 121 with two Fiberglass layers 230, the inner border portion 120, and the outer border portion 122. As described above, the border portion 121 may be less rigid than the center portion 118 and in some embodiments may taper on one or both sides of the body 105 from the center portion 118 to the outer border portion 122. In an exemplary embodiment, the center portion 118 may comprise a thickness of approximately ¼ inch and may taper to 0 inch at the outer border portion 122. The tapers of the border portion 121 may allow adjacent stamps 100 to overlap with each other without creating unintentional lines or designs in the stamped surface. In an exemplary embodiment, the border portion 121 extends approximately 2-3 inches from the center portion 118. The magnet 125 is positioned in the border portion 121 so as to create a magnetic attraction with an adjacent stamp. This may allow adjacent stamps 100 to connect and align with each other so as to create a seamless pattern on a surface.

FIGS. 2B-2E are side views of exemplary embodiments of structures for engaging a stamp with an adjacent stamp. In FIG. 2B, a stamp 100A engages with a stamp 100B via magnets 125A and 125B. In this embodiment, a portion of the stamp 100A overlaps with a portion of the stamp 100B such that the magnets 125A and 125B are vertically aligned. Of course the magnets 125A and 125B need not be vertically aligned and may only be positioned relative to each other so that a magnetic attraction is created between the magnets. The magnets 125A and 125B may be configured such that their respective magnetic fields attract each other. In some embodiments, the magnet 125B may comprise a magnet or ferromagnetic material that is attracted to the magnet 125A. Once the magnets 125A and 125B are close enough that they are magnetically attracted to each other, the magnetic attraction or force facilitates keeping the stamps 100A and 100B together and/or in alignment. The engagement of the stamps 100A and 100B together and/or into alignment may provide a physical and audible confirmation to the installer that the stamp installation is complete. In some embodiments, an audible sound is heard when the stamps 100A and 100B are engaged.

As shown, the magnets 125A and 125B are secured within the stamps 100A and 100B with one or more Fiberglass layers 230A and 230B. Similar to FIG. 2A, FIG. 2B illustrates a stamp 210A engaging with a stamp 210B via magnets 125A and 125B. In this embodiment, the stamps 210A and 210B horizontally abut one another and the magnets 125A and 125B are configured such that their respective magnetic fields attract each other. As in FIG. 2A, the magnetic attraction of the magnets 125A and 125B may facilitate keeping the stamps 100A and 100B together and/or in alignment and there may be an audible sound when the stamps 100A and 100B are engaged.

Figure 2D:
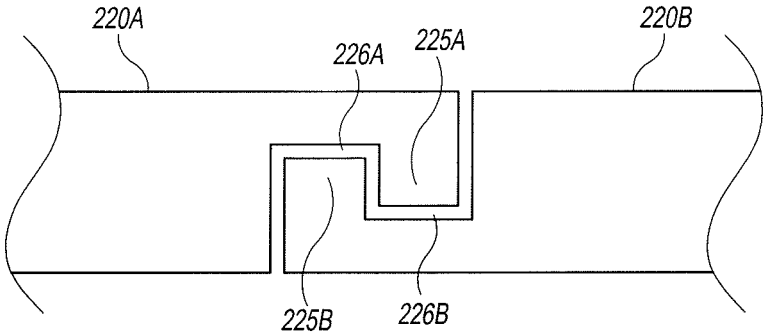
FIG. 2D is a side view of a stamp showing another embodiment of a structure for engaging adjacent stamps using pins and recesses.

In FIG. 2D, a stamp 220A engages with a stamp 220B via pins 225 and recesses 226. As shown, pin 225A of stamp 220A engages with recess 226B of stamp 220B and pin 225B of stamp 220B engages with recess 226A of stamp 220A so as to keep stamps 220A and 220B in place relative to each other. In some embodiments, pins 225 and recesses 226 may be local to certain areas of the stamps 200. In other embodiments the pins 225 and recesses 226 may be located around an entire circumference of the stamps 220A, 220B. In some embodiments, the stamp 220A may consist of only pins 225A and the stamp 220B may consist of only recesses 226B so that the pins 225A engage with the recesses 226B.

Figure 2E:
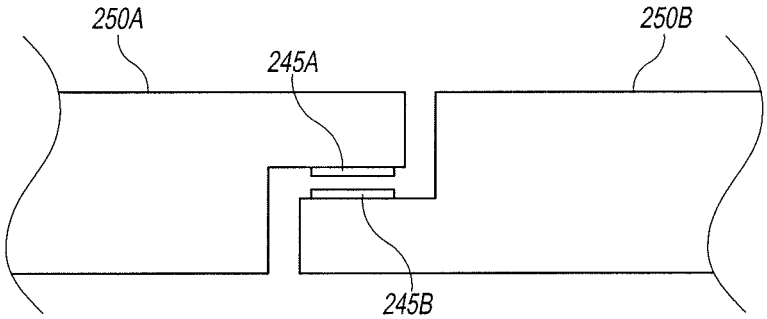
FIG. 2E is a side view of a stamp showing another embodiment of a structure for engaging adjacent stamps using adhesives.

In FIG. 2E, a first stamp 250A engages with a second stamp 250B via adhesives 245A and 245B. The adhesives 245A and 245B may comprise glue, paste, mastic, Velco or other substance that causes the stamp 250A to adhere to stamp 250B. When the adhesives 245A and 245B engage with each other, the stamps 250A and 250B may be held in place relative to each other. In some embodiments, adhesives 245 may be local to certain areas of the stamps 250 or may be located around the entire circumference of the stamps 250.

Figure 3:
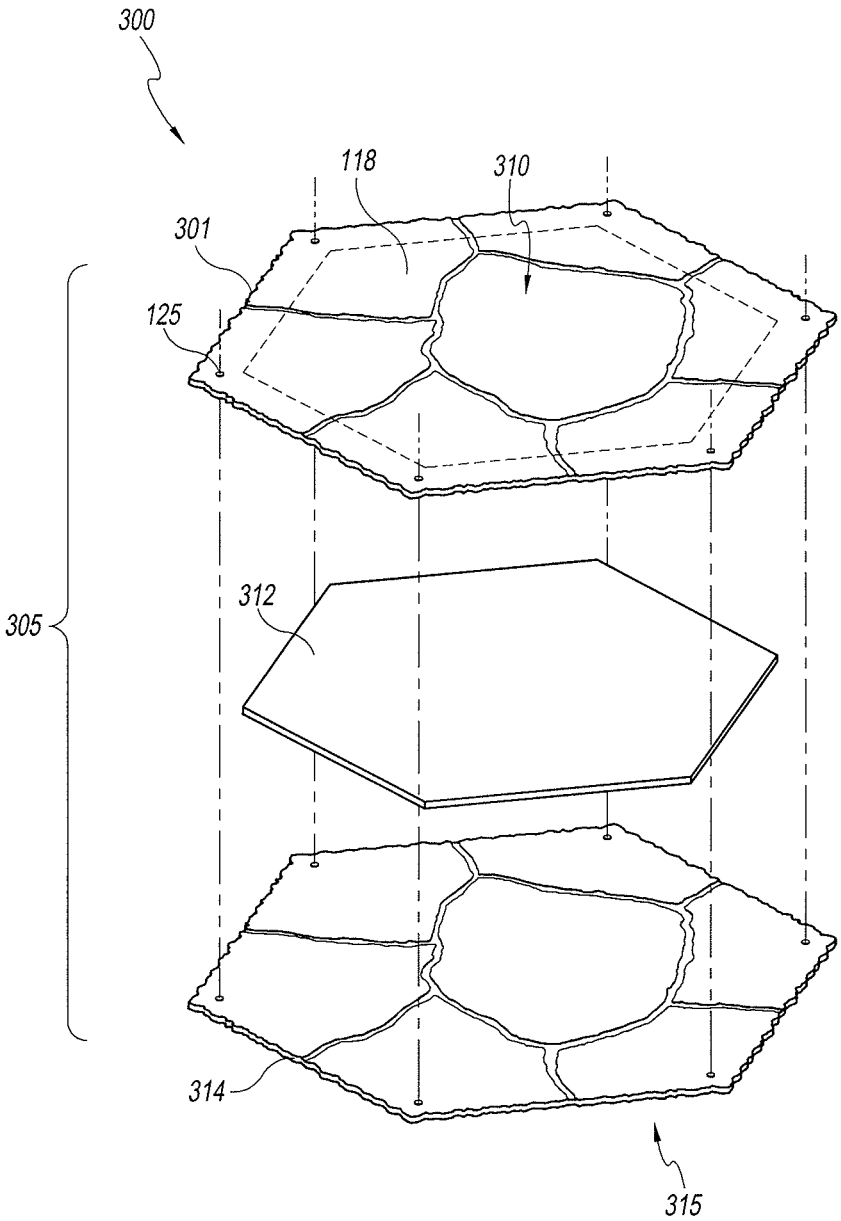
FIG. 3 is an exploded view of a stamp that includes a support structure, in accordance with an exemplary embodiment described herein.

FIG. 3 is an exploded view of a stamp 300 in accordance with exemplary embodiments described herein. The stamp 300 may comprise a body 305 having one or more layers. As shown in FIG. 3, the body 305 comprises a layer 301 which comprises a top surface 310. The stamp 300 also comprises a support structure 312 and a layer 314. The layer 314 comprises a bottom surface 315. As shown, the support structure 312 is positioned between layer 301 and layer 314. As shown in FIG. 3, the stamp 300 comprises two layers surrounding the support structure, however, in other embodiments, the stamp 300 may comprise more or fewer layers. For example, the support structure 312 may be positioned within a single layer of the body 305. In some embodiments, the support structure 312 may comprise one or more layers of the same or different materials, or may be omitted. Though the support structure 312 is shown to be hexagonal, it may be of any other geometric shape or size. For example, the support structure 312 may comprise a continuous plate, a ring shape, a spine structure, a mesh structure, one or more plates coaxially arranged with varying thickness, or any other arrangement to provide body support to the stamp 300. As illustrated in FIG. 3, support structure 312 has the same hexagonal shape as the layer 301 and layer 314 and is a size that corresponds to the size of the center portion 118 of FIG. 1A. In some aspects, the support structure 312 may comprise a Fiberglass material. In other embodiments, the support structure 312 may comprise any material which increases the stability and rigidity of the center portion 118. A non-limiting benefit of the support structure 312 is that it may increase the overall strength of the stamp 300 or may provide increased support around the border portions of the stamp 300 to increase durability when connecting to another stamp. Similar to stamp 100, stamp 300 comprises one or more magnets 125 disposed around a border portion for connecting and/or aligning multiple stamps 300 on a surface.

Figure 4A:
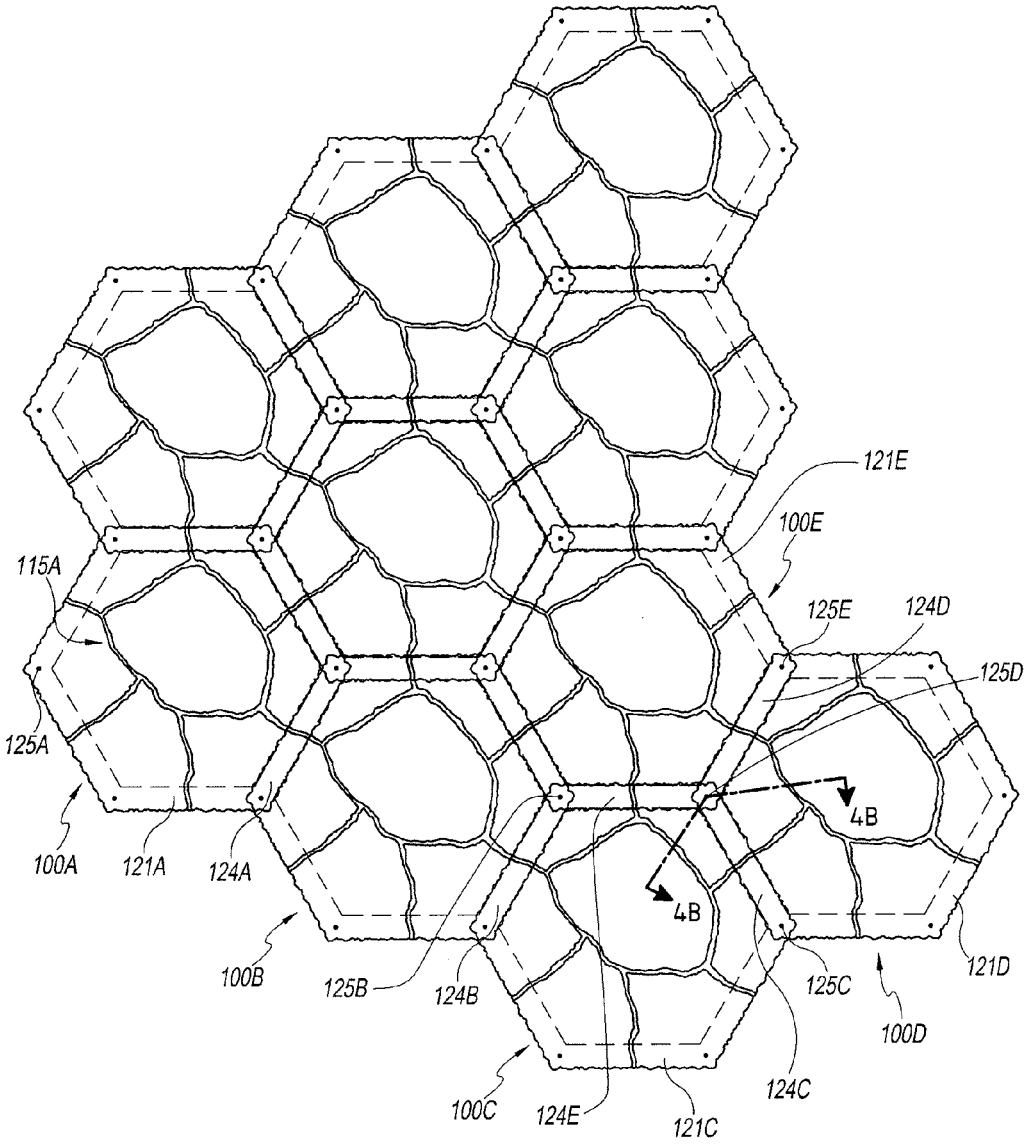
FIG. 4A is a schematic view of a step in a method for creating a pattern using the stamp disclosed in FIG. 1A.

FIG. 4A is a bottom schematic view of a step in a method for creating a pattern using the stamp 100. As shown in FIG. 4A, multiple stamps 100 are layered on a surface (e.g., concrete or cement) and overlap each other in border portions 121 (feathered edges) of the stamp 100. Adjacent stamps 100 are aligned with adjacent stamps 100 using the magnets 125 and overlapping border portions 121. For example, stamp 100C and stamp 100D overlap in section 124C and connect at magnets 125C and 125D. Section 124C comprises the region where border portion 121C overlaps with border portion 121D and creates a seamless connection between stamps 100C and 100D such that the designs of stamp 100C and stamp 100D align correctly showing no discernible edges of the stamps 100C and 100D used to make the pattern. Additionally, stamp 100E may be connected to stamps 100C and 100D by aligning and connecting the stamps with magnets 125B, 125D, and 125E, as shown in FIG. 4A. This alignment creates overlapping portion 124C of the border portions 121 of stamp 100E and 100C and creates an overlapping portion 124D between stamps 100E and 100D.

Figure 4B:
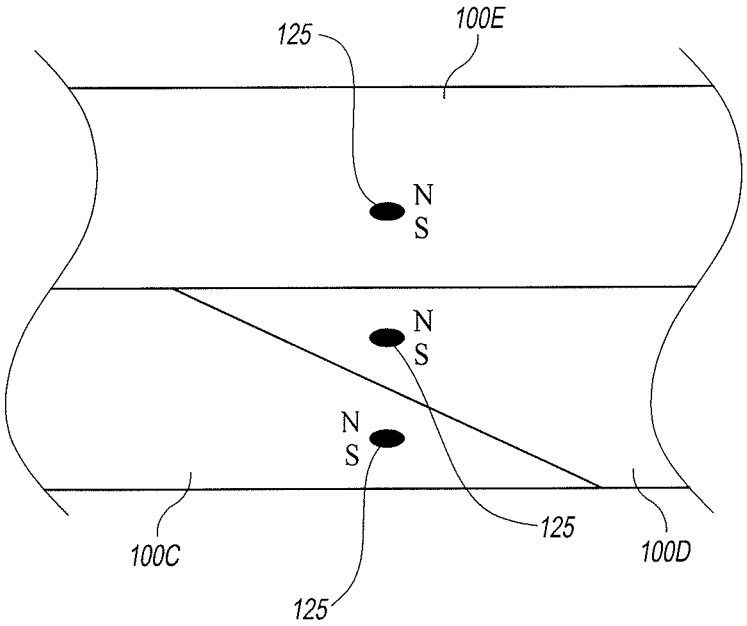
FIG. 4B is a partial cross-sectional view from FIG. 4A along the line 4B-4B engaging a stamp with two adjacent stamps using overlapping magnets.
Figure 4C:
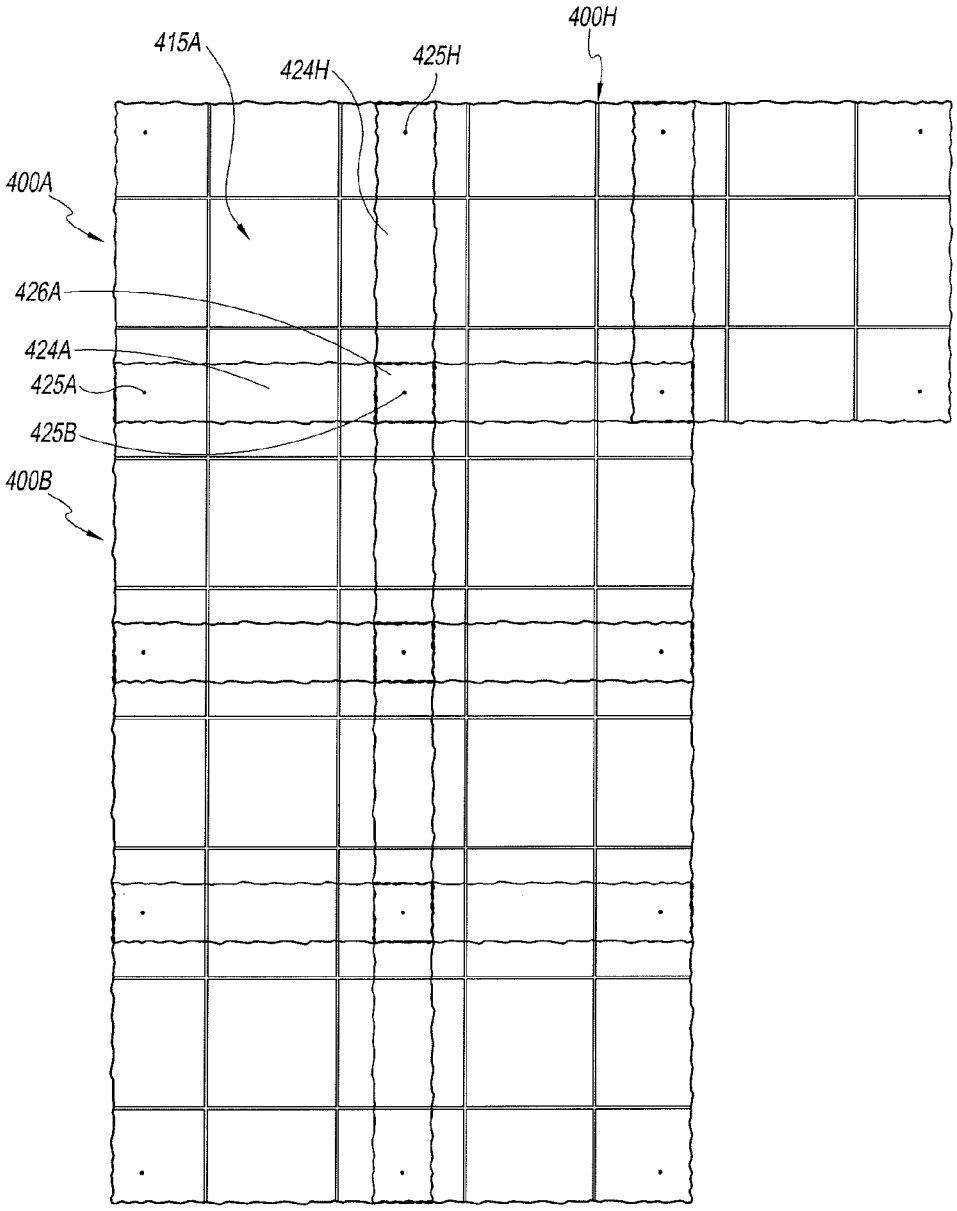
FIG. 4C is a schematic view of a step in a method for creating a pattern using a stamp according to another patterned embodiment of the present invention.

The three stamps 100C, 100D, and 100E all overlap in the region surrounding magnet 125D. FIG. 4B is a cross-sectional view of an exemplary arrangement of the stamps 100C, 100D, and 100E engaging with each other in the region surrounding magnet 125D. In this region, the magnets 125 of the three stamps 100C, 100D, and 100E are arranged such that the magnets of stamps attract the magnets of the adjacent stamp. For example, as shown in FIG. 4B, the stamp 100C may be placed on the surface first and the stamp 100D may be placed on the surface next such that its border portion 121D is placed on top of the border portion 121C. In this way, the magnet 125 of the stamp 100D is on top of the magnet 125 of the stamp 100C at the magnet locations 125C and 125D. In the region surrounding magnets 125D, as shown, the south pole of the magnet 125 of stamp 100D is attracted to the north pole of the magnet 125 of stamp 100C. Next, the stamp 100E may be placed on the surface such that the border portion 121E is placed above the border portion 121D. In this way, the magnets 125 of the stamp 100E are above the magnets 125 of the stamp 100D at the magnet locations 125D and 125E. The stamp 100E is also placed such that its magnet at 125D is attracted to the magnet 125 of stamp 100D at 125D. As shown, the stamp 100E is positioned such that the south pole of the magnet 125 of stamp 100E is attracted to the north pole of the magnet 125 of stamp 100D. In some embodiments, the stamps 100A-E may include an indication noting the position of the magnets 125 on each stamp. In other aspects, the installer may rotate the stamp 100 to ensure the magnets 125 attract each other. In a similar manner, the remaining stamps 100 may be affixed and aligned to their adjacent stamps 100 to create a stone pattern along a portion of a surface. FIG. 4A is an example of a pattern that can be rotated in increments of 60° at a time. FIG. 4C is an example of a pattern that can be rotated in increments of 90° at a time.

FIG. 4C is a schematic view of a step in a method for creating a pattern using a stamp 400. The stamps 400 are square shaped as opposed to the hexagonal shaped stamps 100. The stamps 400 comprise substantially similar components and features as the stamps 100. As shown in FIG. 4B, the multiple stamps 400 may be positioned so that adjacent stamps 400 overlap at certain portions 424. For example, stamp 400A and stamp 400B may overlap their border portions by positioning the magnets 425A and 425B to create a magnetic field which attracts the magnets to each other. In a similar manner, stamp 400H may be connected and aligned with stamp 400A by positioning the magnets 425H and 425B to create an overlapping portion 424H. Remaining stamps 400 may be connected to adjacent stamps 400 in the similar manner to create the seamless and continual square tile pattern shown in FIG. 4C, on the surface.

FIG. 5 is a bottom schematic view of a step in a method for creating a pattern using a stamp 500. In this embodiment, the stamp 500 is a stencil of the stone design of the stamps illustrated in FIGS. 1A-1D, 3, and 4A. In some embodiments, the stamp 500 replicates a grout line pattern or border pattern between stone designs in the surface.

In certain embodiments, the stamp 500 comprises a design portion 530 and a textured portion 521. In some embodiments, the textured portion 521 as least partially surrounds the design portion 530. Though a stone design is illustrated here, many other designs are possible, for example brick, tile, cobble stone, travertine, custom stamps, etc. By using a stamp 500 in the form of a stencil, the stamp 500 may have the benefit of being lighter in weight and easier to manage over traditional large scale stamps.

The stamp 500 also includes one or more structures for engaging or registering with an adjacent stamp 500. The one or more structures may comprise any of the structures described above with respect to FIGS. 1-4C. For example, the stamp 500 comprises magnets 125 for engaging adjacent stamps 500. In certain embodiments, the magnets 125 are disposed around outer edges of the stamp 500 for connecting and/or aligning multiple stamps 500 on a surface. In the exemplary embodiment shown in FIG. 5, twelve magnets 125 are positioned toward the outer edges and in the textured portion 521 of the stamps 500.

The number and arrangement of magnets 125 may be changed in any way which facilitates attachment between adjacent stamps 500. As shown in FIG. 5, multiple stamps 500 are layered on a surface (e.g., concrete or cement). The stamps 500 can overlap each other in sections 550, 551, and 552. Stamps 500 are aligned with adjacent stamps 500 using the magnets 125 and overlapping portions of the stamps 500. For example, stamp 500A and stamp 500C overlap in section 550 and the magnets 125A and 125C connect such that the textured portions 521A and 521C align correctly and the stamps 500A and 500C engage with one another and are held in place. Similarly, sections 551 and 552, illustrate regions where stamp 500A may be connected to stamp 500B and where stamp 500B may be connected to stamp 500C in a like manner as described with respect to section 550. Additionally, FIG. 5 illustrates how a stamp 500D is added to the collection of stamps 500 already placed on the surface. As indicated by the arrows, the magnets 125D may engage with the magnets 125A and 125C to connect to stamps 500A and 500C, respectively.

In some embodiments, the stamp 500 may replicate a grout line pattern or border pattern between stone designs in the surface. It may be desirable to add additional detail or designs in the surface between the grout line or border patterns (e.g., design portions 530) to customize the appearance of the surface. For example, FIG. 5 also illustrates a bottom view of a stamp 575 that may be placed on the surface in between design portions 530 of the stamps 500. As shown, stamp 575 may be placed in an uncovered portion 520A of stamp 500A. Similarly, the stamp 575 may be placed in uncovered portions 520B, 520C, 520D, or 520X of the stamps 500A-D. While a square textured stamp is shown for stamp 575, other shapes, sizes, and designs are also possible. In some embodiments, one or more stamps 575 may be placed within the portions 520A, 520B, 520C, 520D, or 520X to cover the entire surface area of the respective portion. In embodiments where two or more than stamps 575 are used, the two or more stamps 575 may be aligned using any of the methods or structures for engaging and aligning adjacent stamps described above. The stamps 575 may be placed on the surface before or after the stamps 500 have been placed on the surface in order to create a desired pattern within the uncovered portions of the stamps 500.

In some embodiments, the structures for engaging or registering a stamp with an adjacent stamp described above with reference to FIGS. 1-5 may comprise a separate coupling structure for engaging or locking a stamp adjacent to another stamp. In some aspects, it may be beneficial to position stamps on a surface without portions of the stamps overlapping. This configuration may allow for the same distal configuration of the stamps on the surface without the need to rotate or flip a stamp to match the engagement structures of adjacent stamps. However, the stamps may still require an engagement or coupling structure to remain in place during the stamping process. The coupling structure may comprise any geometric shape or size and may comprise any structure for engaging the coupling structure with at least two adjacent stamps.

Figure 6A:
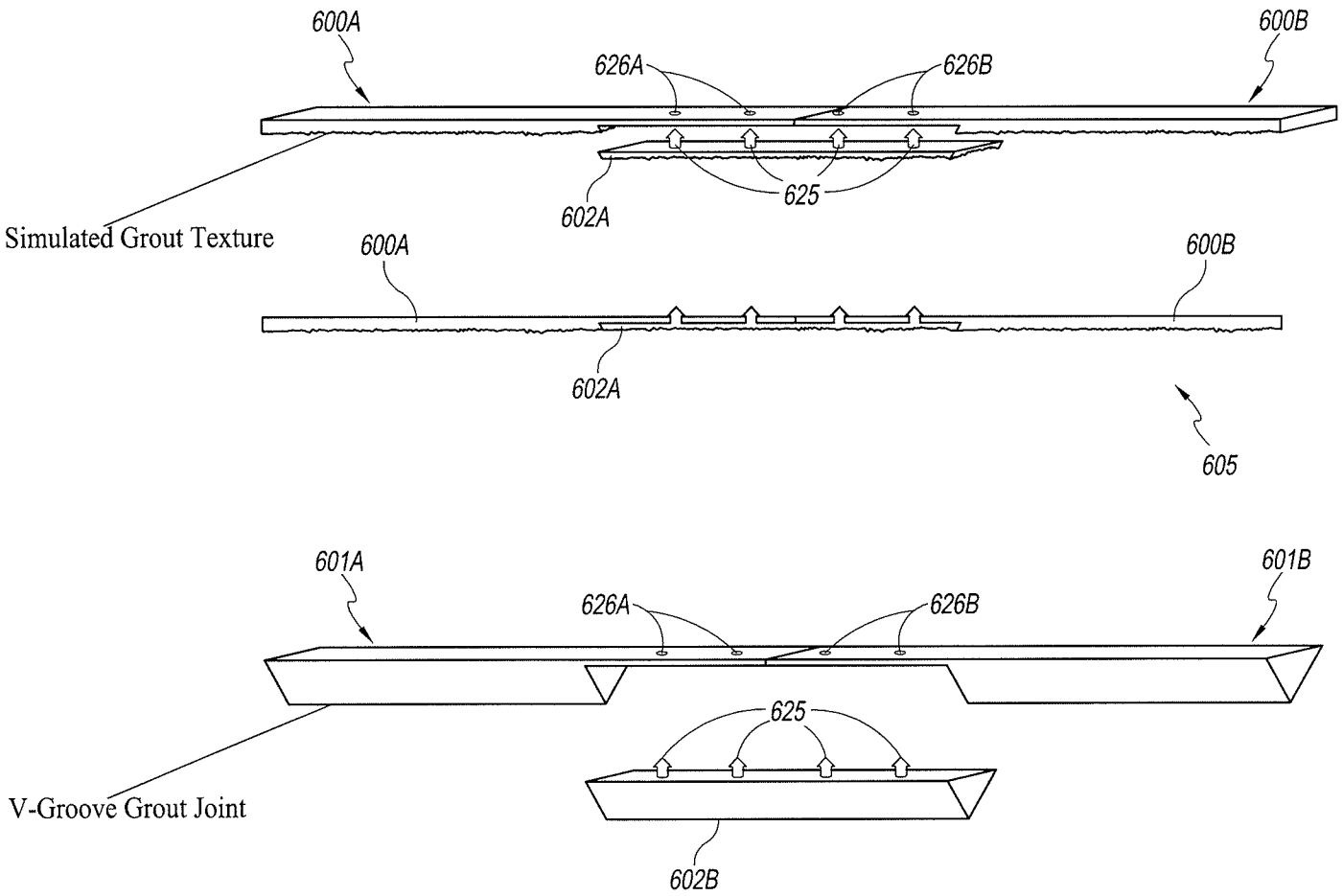
FIG. 6A is a diagram of exemplary coupling structures, in accordance with exemplary embodiments described herein.

For example, FIG. 6A is a diagram of exemplary coupling structures, in accordance with embodiments described herein. FIG. 6A illustrates border portions of simulated grout texture stamps 600A and 600B abutting and adjacent to one another. As shown, the border portions comprise holes or recesses 626A and 626B of the stamps 600A and 600B, respectively, however, the border portions may comprise any of the structures discussed herein for engaging stamps (e.g., recesses, pins, adhesives, magnets, etc.). FIG. 6A also illustrates a coupling structure 602A. In some embodiments, the coupling structure 602A may comprise one or more pins 625 configured to fit in the recesses 626A and 626B. Although four total pins and recess are shown, there may be fewer or more pins and recesses on the coupling structure and/or stamps. Additionally, although pins 625 are shown on the coupling structure 602A and recesses 626A, 626B are shown on the stamps 600A and 600B, the pins 625 may be located on the stamps 600A and 600B and the recesses 626A, 626B may be located on the coupling structure 602A. Additionally, as described above the coupling structure 602A may comprise any of the structures disclosed herein for engaging stamps (e.g., recesses, pins, adhesives, magnets, etc.). Moreover, while the coupling structure 602A is shown coupling stamps 600A and 600B from the bottom, the coupling structure 602A may also be placed on top of the stamps 600A and 600B. Configuration 605 in FIG. 6A illustrates the coupling structure 602A engaged with the stamps 600A, 600B.

The coupling structure may comprise any geometric shape or size and may comprise any structure for engaging the coupling structure with at least two adjacent stamps. For example, FIG. 6A illustrates a coupling structure 602B configured to couple "V" groove grout stamps 601A and 601B adjacent to one another. As shown, the coupling structure 602B is configured to match the "V" groove grout design of the stamps 601A and 601B, however, the coupling structure may be configured to match any stamp design.

Figure 6B:
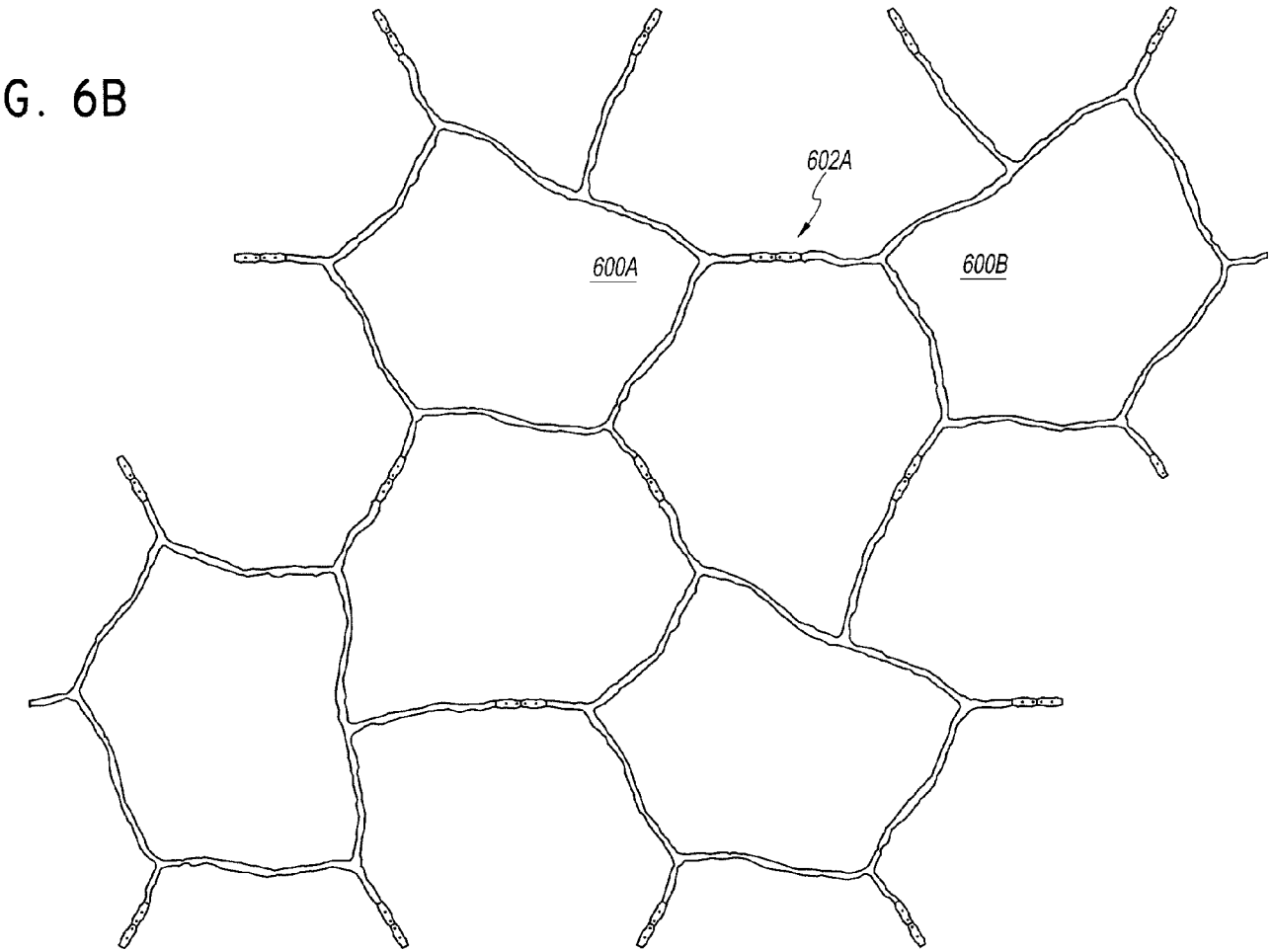
FIG. 6B is a top view diagram of a plurality of adjacent stamps showing border portions secured by one of the coupling structures from FIG. 6A.
Figure 6C:
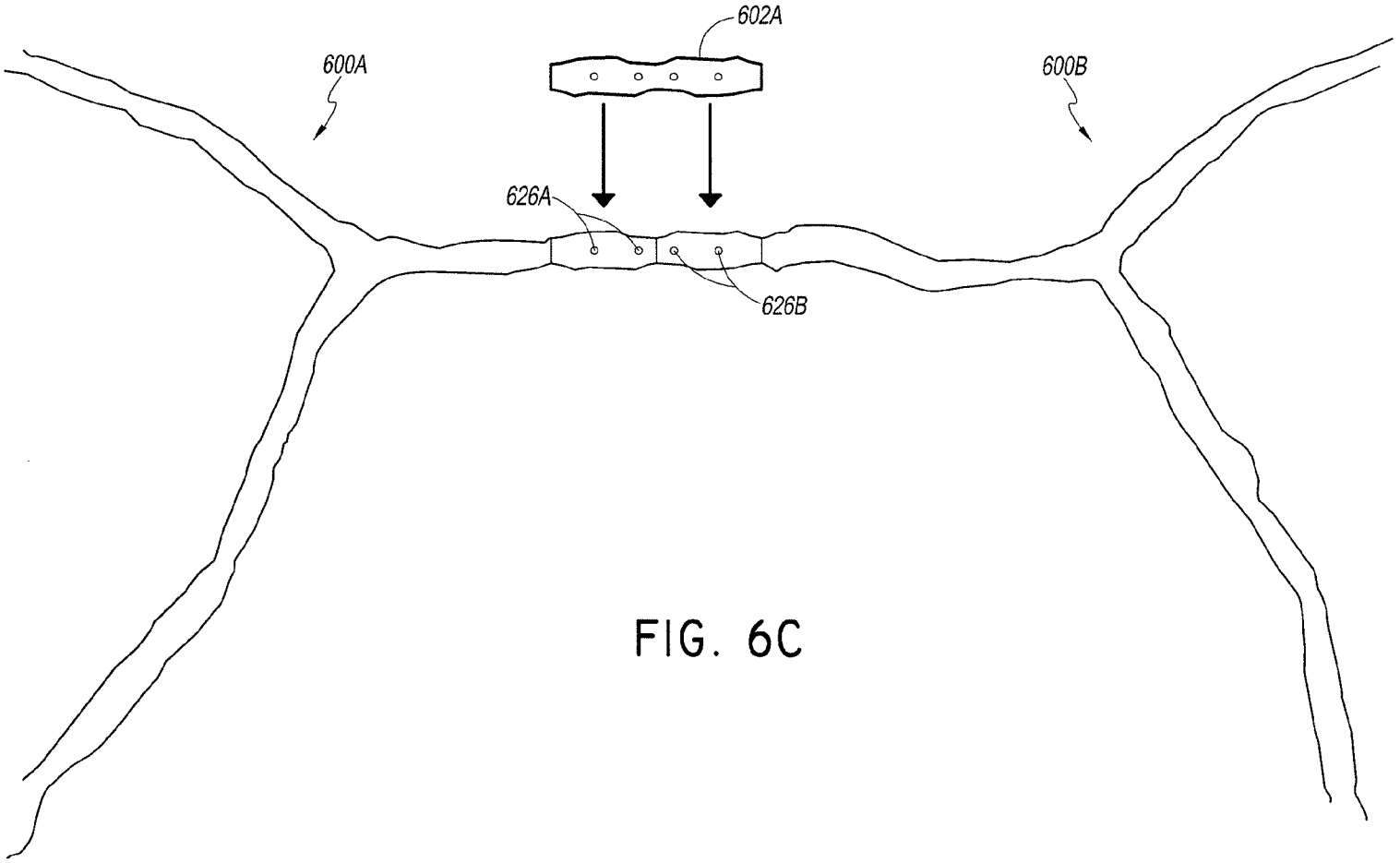
FIG. 6C illustrates a portion of FIG. 6B showing the coupling structure disposed above the border portions of adjacent stamps.

FIG. 6B is a top view diagram of a plurality of adjacent stamps showing border portions secured by the coupling structure 602A from FIG. 6A. FIG. 6C illustrates a portion of FIG. 6B showing the coupling structure 602A disposed above the border portions of adjacent stamps 600A, 600B. As shown, stamps 600A and 600B are positioned adjacent to one another with the coupling structure 602A located above the stamps 600A and 600B. As described above, the pins 625 may couple to the recesses 626A and 626B to facilitate locking the stamps 600A and 600B in place and adjacent to one another.

While the disclosure has been illustrated and described in detail in the drawings and foregoing description, such illustration and description are to be considered illustrative or exemplary and not restrictive. The disclosure is not limited to the disclosed embodiments. Variations to the disclosed embodiments can be understood and effected by those skilled in the art in practicing the claimed disclosure, from a study of the drawings, the disclosure and the appended claims.

Unless otherwise defined, all terms (including technical and scientific terms) are to be given their ordinary and customary meaning to a person of ordinary skill in the art, and are not to be limited to a special or customized meaning unless expressly so defined herein. It should be noted that the use of particular terminology when describing certain features or aspects of the disclosure should not be taken to imply that the terminology is being re-defined herein to be restricted to include any specific characteristics of the features or aspects of the disclosure with which that terminology is associated. Terms and phrases used in this application, and variations thereof, especially in the appended claims, unless otherwise expressly stated, should be construed as open ended as opposed to limiting. As examples of the foregoing, the term 'including' should be read to mean 'including, without limitation,' 'including but not limited to,' or the like; the term 'comprising' as used herein is synonymous with 'including,' 'containing,' or 'characterized by,' and is inclusive or open-ended and does not exclude additional, unrecited elements or method steps; the term 'having' should be interpreted as 'having at least;' the term 'includes' should be interpreted as 'includes but is not limited to;' the term 'example' is used to provide exemplary instances of the item in discussion, not an exhaustive or limiting list thereof; adjectives such as 'known', 'normal', 'standard', and terms of similar meaning should not be construed as limiting the item described to a given time period or to an item available as of a given time, but instead should be read to encompass known, normal, or standard technologies that may be available or known now or at any time in the future; and use of terms like 'preferably,' 'preferred,' 'desired,' or 'desirable,' and words of similar meaning should not be understood as implying that certain features are critical, essential, or even important to the structure or function of the invention, but instead as merely intended to highlight alternative or additional features that may or may not be utilized in a particular embodiment of the invention. Likewise, a group of items linked with the conjunction 'and' should not be read as requiring that each and every one of those items be present in the grouping, but rather should be read as 'and/or' unless expressly stated otherwise. Similarly, a group of items linked with the conjunction 'or' should not be read as requiring mutual exclusivity among that group, but rather should be read as 'and/or' unless expressly stated otherwise.

Where a range of values is provided, it is understood that the upper and lower limit, and each intervening value between the upper and lower limit of the range is encompassed within the embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity. The indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All numbers expressing quantities of ingredients, reaction conditions, and so forth used in the specification are to be understood as being modified in all instances by the term 'about.' Accordingly, unless indicated to the contrary, the numerical parameters set forth herein are approximations that may vary depending upon the desired properties sought to be obtained. At the very least, and not as an attempt to limit the application of the doctrine of equivalents to the scope of any claims in any application claiming priority to the present application, each numerical parameter should be construed in light of the number of significant digits and ordinary rounding approaches.

Furthermore, although the foregoing has been described in some detail by way of illustrations and examples for purposes of clarity and understanding, it is apparent to those skilled in the art that certain changes and modifications may be practiced. Therefore, the description and examples should not be construed as limiting the scope of the invention to the specific embodiments and examples described herein, but rather to also cover all modification and alternatives coming with the true scope and spirit of the invention.

What is claimed is:

1. A method of creating a seamless pattern in cement, concrete, or a similar surface, comprising:

placing a first stamp in a first position, the first stamp having a first pattern, a first border portion defined by a first inner edge and a first outer edge, and comprising a first engagement structure, at least a portion of the first pattern being disposed in the first border portion, the first engagement structure comprising a magnet disposed between the first inner and outer edges, the first engagement structure being configured to overlap and engage with a second stamp; and placing the second stamp in a second position, the second stamp having a second pattern, a second border portion defined by a second inner edge and a second outer edge, and comprising a second engagement structure, at least a portion of the second pattern being disposed in the second border portion, the second engagement structure comprising a magnet disposed between the second inner and outer edges, wherein the second engagement structure overlaps with the first border portion and engages with the first engagement structure so as to position the second stamp and the portion of the second pattern in both an X and Y direction relative to the first stamp to create a seamless pattern with the first pattern of the first stamp.

2. The method of claim 1, wherein the first stamp further comprises a center portion, the first border portion being thinner than the center portion.

3. The method of claim 1, wherein the first stamp comprises one or more portions of varying thickness.

4. The method of claim 1, wherein the first stamp comprises one or more layers.

5. The method of claim 1, wherein the first stamp comprises one or more recesses, the one or more recesses comprising one or more handles.

6. The method of claim 1, wherein a center portion of the first stamp is more rigid than the first border portion.

7. The method of claim 1, wherein the first engagement structure is embedded within the first stamp.

8. The method of claim 1, wherein the first stamp is formed into a stencil, and wherein the first engagement structure is disposed in an outer portion of the stencil.

9. The method of claim 1, further comprising a support structure disposed within the first stamp and configured to secure the first engagement structure within the first stamp.

10. The method of claim 1, further comprising a support structure at least partially surrounding the first engagement structure.

11. The method of claim 1, wherein the support structure comprises a metal material at least partially surrounding the first engagement structure.

12. The method of claim 9, wherein the support structure comprises a material with a higher durometer than a body of the first stamp.

13. The method of claim 9, wherein the support structure comprises one or more layers.

14. The method of claim 1, further comprising placing a third stamp in a third position, the third position located at least partially within the first border portion, the second border portion, or a portion of an area created by positioning the first stamp relative to the second stamp.

15. A plurality of stamps for forming a seamless pattern in cement, concrete, or a similar surface, each stamp comprising:

a surface having a pattern;

a border portion defined by an inner edge and an outer edge, wherein at least a portion of the pattern is disposed in the border portion; and an engagement structure having at least one magnet configured to create a magnetic attraction with an adjacent stamp of the plurality of stamps so as to position each stamp in both an X and Y direction relative to the adjacent stamp to create a seamless connection between adjacent patterns, wherein the at least one magnet is disposed between the inner and outer edges of each stamp and configured to overlap and engage the adjacent stamp.

16. The plurality of stamps of claim 15, further comprising a support structure disposed within each stamp and at least partially surrounding the at least one magnet, wherein the support structure is configured to support the at least one magnet within each stamp.

* * * * *